United States Patent [19]

Gazdik et al.

[11] Patent Number: 4,842,690

[45] Date of Patent: Jun. 27, 1989

[54] MIXING CHLORINE GAS INTO PAPER PULP SLURRIES

[75] Inventors: Lawrence E. Gazdik; Edward F. Allard, both of Glens Falls, N.Y.

[73] Assignee: Kamyr, Inc., Glens Falls, N.Y.

[21] Appl. No.: 866,732

[22] Filed: May 27, 1986

[51] Int. Cl.[4] ..... D21C 9/12

[52] U.S. Cl. ..... 162/57; 162/66; 162/88

[58] Field of Search ..... 162/66, 67, 88, 89, 162/57, 65

[56] References Cited

U.S. PATENT DOCUMENTS

| | | | |
|---|---|---|---|
| 4,093,506 | 6/1978 | Richter | 162/57 |
| 4,427,489 | 1/1984 | Jacobsen | 162/66 |
| 4,577,974 | 3/1986 | Prough et al. | 162/57 |

FOREIGN PATENT DOCUMENTS

| | | | |
|---|---|---|---|
| 53-9286 | 4/1978 | Japan | 162/65 |

OTHER PUBLICATIONS

Kohn, Ed., "Pulp-Bleaching Process Cuts Costs, Time, Effluent;" *Chemical Engineering,* McGraw Hill Publishers, Feb. 28, 1977, p. 136.

Shera, "Systems Compatibility for ORP Pulp Chlorination Control", *TAPPI,* Feb. 1967, vol. 50, No. 2, pp. 99A-103H.

*Primary Examiner*—Steve Alvo

*Attorney, Agent, or Firm*—Nixon & Vanderhye

[57] ABSTRACT

Chlorine gas is directly introduced, without the necessity of adding water with the gas, into a paper pulp slurry (i.e. comminuted cellulosic fibrous material) having a consistency of between about 6-15 percent. The gas is added to the inlet of a fluidizing mixer at the point where the slurry enters the fluidizing mixer, and is intimately mixed with the pulp by the mixer. The flow of the chlorine gas is in a flow controlled pathway, which is split into at least two flows so as to increase the total gas volume added to the pulp stock and obtain enhanced mixing. Each of the split flows is introduced to the inlet of a fluidizing mixer. The split flow addition of chlorine gas into two or more mixer inlets also may be practiced for low consistency pulp (e.g. pulp having a consistency of between about 1-5 percent).

4 Claims, 2 Drawing Sheets

MIXING CHLORINE GAS INTO PAPER PULP SLURRIES

BACKGROUND AND SUMMARY OF THE INVENTION

In the treatment of slurries of comminuted cellulosic fibrous material (i.e. paper pulp slurries), the common practice when bleaching with chlorine is to introduce chloride gas mixed with water into a low consistency slurry, that is a slurry having a solids concentration of between about 1–5 percent. The chlorine gas and water are usually introduced into the slurry at a conventional mixer inlet. The gas and slurry are mixed together by the mixer, and when discharged from the mixer may additionally be passed to another mixer for further mixing action.

According to the present invention it is desirable to introduce chlorine gas into a paper pulp slurry to effect treatment thereof in manner that is simplified compared to the prior art, and which allows for more versatile mixing of the chlorine gas and the pulp, and additionally allows the introduction of a higher volume of gas into the pulp with effective mixing.

According to one aspect of the present invention, the volume of gas that may be introduced into the slurry is enhanced by providing the gas in a flow controlled pathway, splitting the pathway into at least two (i.e. a plurality of) paths, and directing each path to an inlet to a mixer, the mixers connected in series in the flow of low consistency pulp stock.

According to another aspect of the present invention, it is possible to enhance the flexibility of the chlorine gas bleaching of pulp by mixing the gas into a medium consistency paper pulp slurry (e.g. a slurry having a consistency of between about 6–15 percent, and preferably between about 8–12 percent). The chlorine gas may be introduced directly into the inlet to a fluidizing mixer, and there is no necessity or desirability of introducing the gas with water. The fluidizing mixer, which may be of the type such as shown in U.S. Pat. Nos. 4,577,974 or 4,543,181, or that sold commercially by Kamyr, Inc. of Glens Falls, N.Y. and Kamyr AB of Karlstad, Sweden under the trademark "MC", effects fluidization of the pulp, intimately mixing the gas and pulp together. In order to increase the volume of chlorine gas added, and obtain enhanced mixing, it is desirable—as in the case of the low consistency pulp—to split the flow controlled pathway of chlorine gas into a plurality of paths, each path leading to the inlet to one of a series of connected fluidizing mixers. Preferably two mixers are utilized.

It is the primary object of the present invention to provide for the enhanced effectiveness of the introduction of chlorine gas into a paper pulp slurry for treating the slurry with the chlorine gas. This and other objects will become clear from an inspection of the detailed description of the invention and from the appended claims.

DETAILED DESCRIPTION OF THE DRAWINGS

Figure 1:
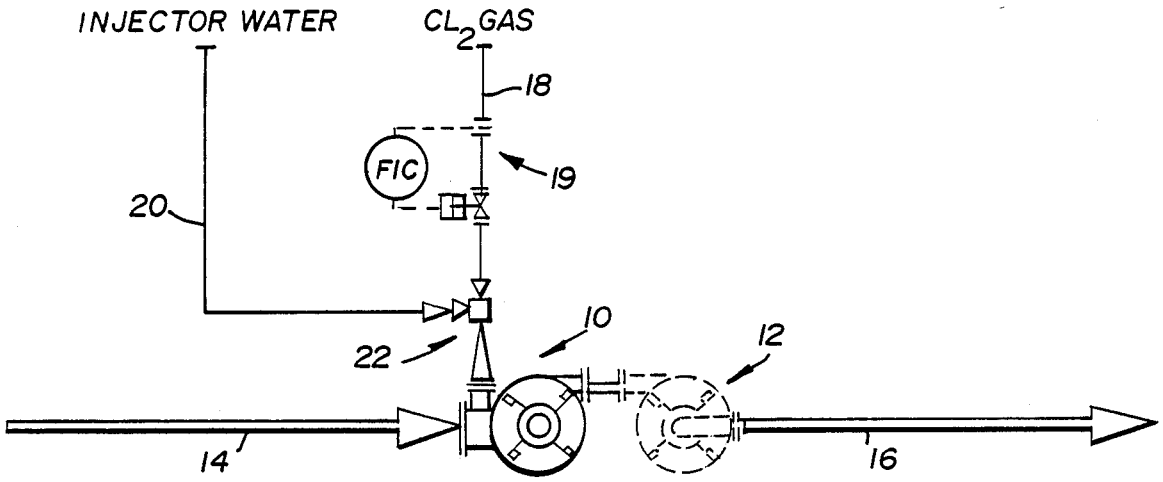
FIG. 1 PRIOR ART
FIG. 1 is a schematic view of an exemplary prior art system for introducing chlorine gas into a mixer to mix the chlorine gas with a low consistency paper pulp slurry.

In the conventional prior art procedure illustrated in FIG. 1, a mixer 10, or a pair of series connected mixers 10, 12, are disposed in a line 14 carrying low consistency (1–5 percent solids) pulp, with a discharge line 16 being provided from the mixers 10, 12 which contains low consistency pulp mixed with chlorine gas. The chlorine gas is provided in a flow controlled pathway 18, flow control apparatus being illustrated schematically at 19, and is introduced into the mixer 10 along with water from line 20 utilizing a conventional injector 22. In the injector 22 a flow of water entrains a flow of chlorine gas therein, and the water with entrained gas is added to the pulp at the inlet to the mixer 10.

Figure 2:
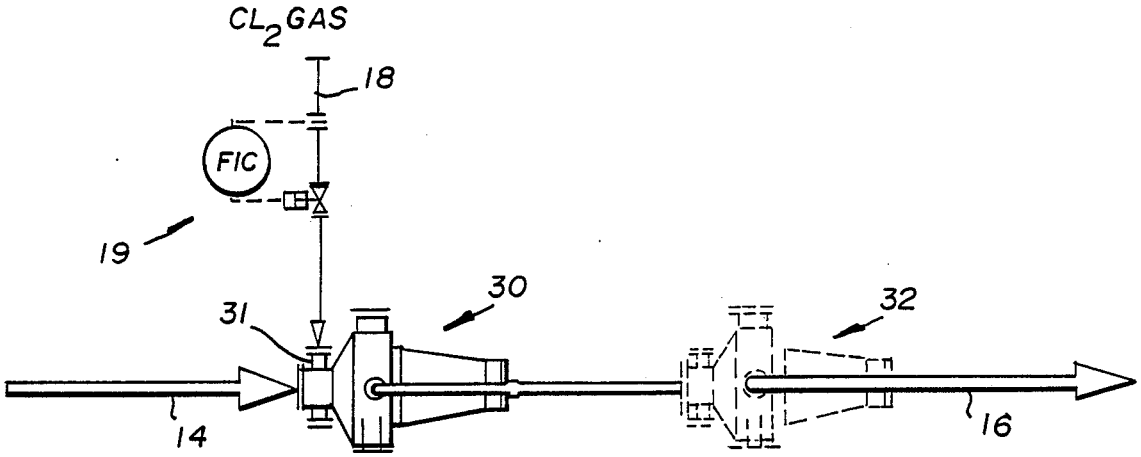
FIG. 2 is a side schematic view of an exemplary system according to the present invention for introducing chlorine gas directly into the flow of a pulp slurry having medium consistency.

An exemplary embodiment of apparatus for practicing a method according to the present invention is illustrated in FIG. 2 which has enhanced effectiveness, and increased versatility, in the introduction chlorine gas into a pulp slurry. Elements in the FIG. 2 embodiment identical to those in the FIG. 1 conventional structure are illustrated by the same reference numeral. Note that in this embodiment the pulp stock flowing in the line 14 is of medium consistency, that is it has a consistency of between about 6–15 percent, and preferably between about 8–12 percent. The series connected mixers 30, 32 that are provided are fluidizing mixers, such as shown in the aforementioned U.S. patents, or the commercially available mixers mentioned above. Chlorine gas in pathway 18, flow controlled by apparatus 19, is introduced directly into the pulp flow at the inlet 31 to the mixer 30, there being no necessity for entraining the chlorine gas flow in water in order to effect introduction. Intimate mixing of the chlorine gas with the slurry then takes place in the fluidizing mixer 30, and in the series connected mixer 32.

Figure 3:
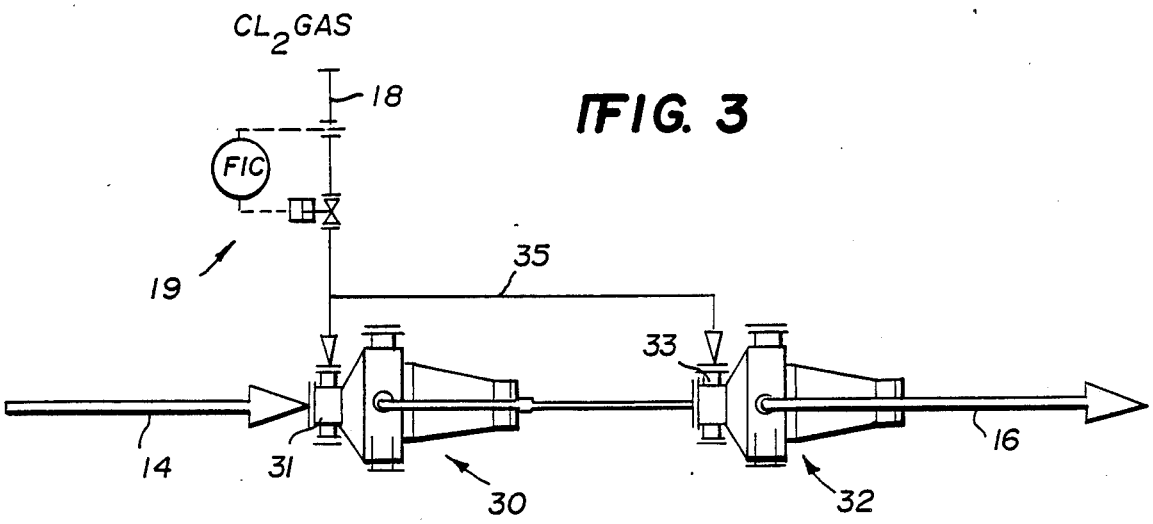
FIG. 3 is another exemplary schematic illustration of apparatus for practicing a method according to the invention wherein a split flow of chlorine gas is provided for introduction into a medium consistency slurry.

The apparatus of FIG. 3 is similar to that of FIG. 2, and like components are illustrated by the same reference numeral. However, utilizing the apparatus of FIG. 3 a higher volume of chlorine gas can be introduced into the flow of medium consistency pulp, and enhanced mixing may be effected. In the apparatus of FIG. 3, the flow controlled chlorine gas pathway 18 is split into a plurality of pathways, one for each of the mixers 30, 32 (preferably two pathways). For instance there is the pathway which is a direct continuation of the line 18 which goes to the inlet 31 for mixer 30, and the pathway 35 (downstream of the flow control apparatus 19) which introduces chlorine gas directly into the inlet 33 to the second fluidizing mixer 32.

Figure 4:
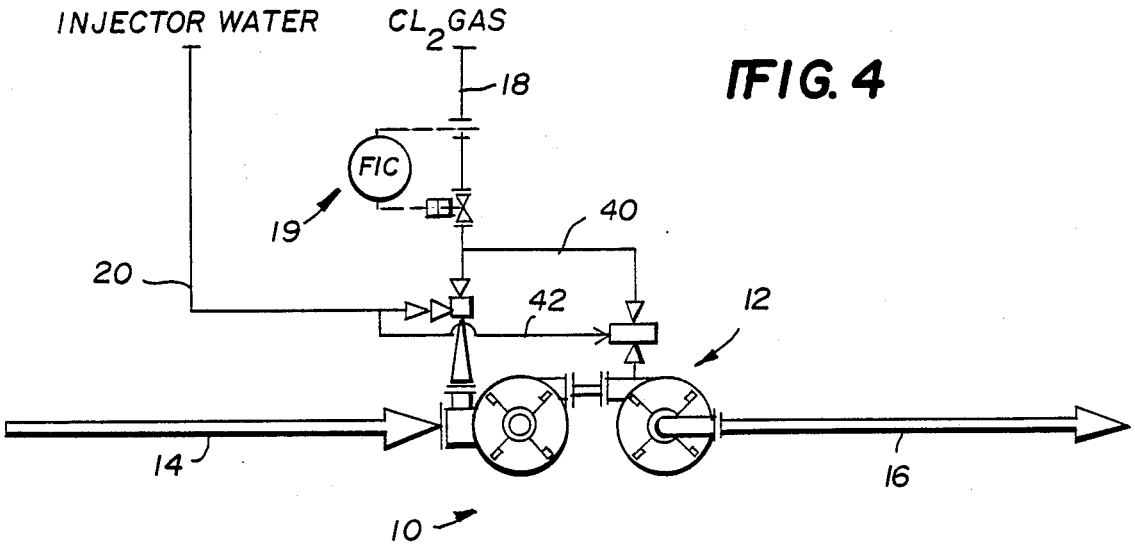
FIG. 4 is a schematic view of another embodiment of exemplary apparatus for practicing a method according to the present invention wherein chlorine gas is introduced in a split flow into a pulp slurry having a consistency between about 1–5 percent.

The apparatus of FIG. 4 practices an enhanced effectiveness method of mixing chlorine gas with pulp similar to the method discussed above with respect to FIG. 3, only for low consistency pulp (i.e. a solids concentration of between about 1–5 percent). In the apparatus of FIG. 4 components comparable to those in the FIG. 1 embodiment are illustrated by the same reference numeral.

In the FIG. 4 embodiment, the pathway of chlorine gas flow is split downstream of the flow control apparatus 19 into a flow pathway which is a continuation of the pathway 18, and a split pathway 40 which is split from the pathway 18. The pathway which is a continuation of the pathway 18 leads directly to the inlet of the first mixer 12, while the pathway 40 introduces the chlorine gas into the second series connected mixer 12.

It will thus be seen that according to the present invention an enhanced method of mixing chlorine gas with a paper pulp slurry is provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and procedures.

What is claimed is:

1. A method of treating a slurry of comminuted cellulosic fibrous material having a consistency of between about 8–15 percent comprising the steps of:

(a) providing a flow controlled feed of chlorine gas;

(b) splitting the flow controlled feed into a plurality of different flow paths;

(c) providing a flow of slurry having a consistency between about 8–15 percent to a plurality of series connected fluidizing mixers; and (d) introducing gas into each of the mixers from a respective one of said plurality of different flow paths so that chlorine gas is added directly to the slurry at an inlet to each of the mixers and the mixers effect fluidization of the slurry with chlorine gas dispersed therein to effect intimate mixing of the chlorine gas with the slurry.

2. A method as recited in claim 1 wherein two series connected fluidizing mixers are provided, and wherein the flow controlled chlorine gas is split into two different flow paths, one for each mixer.

3. A method as recited in claim 2 wherein the introduction of chlorine gas directly into the inlets to the fluidizing mixers consists of the introduction of only chlorine gas into the slurry.

4. A method as recited in claim 1 wherein the introduction of chlorine gas directly into the inlets to the fluidizing mixers consists of the introduction of only chlorine gas into the slurry.

* * * * *